US005284001A

United States Patent [19]

Ochs

[11] Patent Number: 5,284,001

[45] Date of Patent: Feb. 8, 1994

[54] SPINDLE TYPE STRAIGHT LINE CAPPER

[75] Inventor: Charles S. Ochs, Lancaster, Ohio

[73] Assignee: Anchor Hocking Packaging Co., Lancaster, Ohio

[21] Appl. No.: 962,262

[22] Filed: Oct. 16, 1992

[51] Int. Cl.[5] ..... B67B 3/20; B65B 7/28

[52] U.S. Cl. ..... 53/307; 53/317; 53/331.5

[58] Field of Search ..... 53/317, 331.5, 306, 53/303, 304, 307

[56] References Cited

U.S. PATENT DOCUMENTS 3,040,492 6/1992 Stover et al. .
3,134,211 5/1964 Roberts et al. .
3,143,935 8/1964 McElroy et al. .
3,274,748 9/1966 Roberts et al. .
3,309,838 3/1967 Wilhere .
3,392,505 7/1968 Luther .
3,626,658 12/1971 Jones .
4,199,914 4/1980 Ochs et al. .
4,295,320 10/1981 Willingham .
4,364,218 12/1982 Obrist .
4,548,668 10/1985 Roth .
4,696,143 9/1987 Young .
4,716,708 1/1988 Ochs .
5,054,260 10/1991 Herzog .

*Primary Examiner*—Morace M. Culver
*Attorney, Agent, or Firm*—Wood, Herron & Evans

[57] ABSTRACT

The invention concerns an apparatus for applying closures to containers. Each closure is carried to a respective container in a chuck of a closure holder mounted on a closure conveyor. The holder has an axially movable spindle which is yieldably moved from a retracted position to an extended position as the closure conveyor moves. The spindle may be selectively rotated while in extended position, by a pulley which is coupled to it by a clutch. The closures are applied to containers moving on a straight run of a container conveyor. The closure conveyor carries the closures along a linear path parallel to the containers while the spindles are sequentially extended to apply the closures.

36 Claims, 9 Drawing Sheets

SPINDLE TYPE STRAIGHT LINE CAPPER

FIELD OF THE INVENTION

This invention relates to apparatus for placing and sealing caps or closures onto containers, and more particularly to improved high speed sealing machines of the type wherein closures are fed into individual closure-carrying holders or spindles which then deliver and tighten the respective closure on the containers while moving along a straight line path.

BACKGROUND OF THE INVENTION

Various "straight line" cappers or sealing machines for applying closures onto containers are disclosed in U.S. Pat. Nos. 3,143,835; 3,274,748; 3,438,174; 4,199,914; 4,279,115; and 4,716,708. Those machines generally include a linear horizontal conveyor which carries filled but still open containers in a row through a closure feeding device, a closure applicator, and a closure sealer in sequence. The closure feeding device typically feeds or presents the closures to the moving containers by a chute or slide mechanism. As the containers are moved by the conveyor, the leading edge of the presented closure is engaged by the leading edge of the top of the container. The movement of the container pulls the closure from its feed position so that it is seated on the container. A closure applicator then presses the closure onto the container and/or rotates the closure onto the container to seal it.

At operating rates of about 1200 containers per minute and higher, the reliability and accuracy at which previous machines engage and seat the closures upon the containers diminishes. The impact of the leading edge of the container on the closure may "throw" or dislodge the closure so that it does not seat on the container. Another difficulty is that the closure may end up "cocked" or improperly seated on the container, as a result of which it cannot be sealed properly by the subsequent closure applicator and sealing means.

Other types of "straight line" sealing machines are disclosed in U.S. Pat. Nos. 3,392,505 and 4,696,143. The '505 patent is directed to a dual head apparatus for applying closures to containers. A transfer head removes closures from a dispenser and transfers them to an inserter head, which in turn applies the closures to containers. During the transferring step, the closure is reoriented about a transverse axis so that it is presented with its bottom side facing toward the opening of the container to which it will be applied. The complexity of the closure pickup and transfer mechanism of such machines does not lend itself to effective high speed capping.

The '143 patent is directed to a container capping apparatus which includes a rotating carriage that receives closures from a conveyor and applies them to containers moving on a second conveyor. The rotating carriage has a tangential velocity that exceeds the linear velocity of the container conveyor, and thus the speed of the containers on the conveyors is wholly controlled by the rotating carriage. That machine likewise is not capable of effective high speed capping.

In Herzog U.S. Pat. No. 5,054,260, issued Oct. 8, 1991, titled "High Speed Sealing Machine" there is disclosed a sealing machine in which closures are applied by an applicator wheel to containers moving on a straight line. The wheel rotates in a plane parallel to the line of movement of the containers, and has a plurality of closure carriers or holders around its periphery. It is driven at a rate such that the linear speed of the carriers and closures matches that of the containers. Closures are fed to the closure carriers by a star wheel or notched wheel. The star wheel preferably rotates about an axis which is transverse to the axis of rotation of the applicator wheel and which is parallel to the line of movement of the containers on the conveyor. While that machine is capable of applying closures at rates of 1,000 to 2,000 closures per minute, depending upon the type of closure and container, nevertheless it cannot apply some closures at rates as high as would be desired.

Thus there remains a need for an improved closure applicator and sealing machine that can be operated at speeds heretofore not reliably attain able, while still providing good seal integrity with an acceptably low rate of rejections.

SUMMARY OF THE INVENTION

Upon study of a machine of the type shown in the Herzog patent, it was found that a critical limitation on its rate of operation is the fact that the closure carriers (which are positioned radially around the applicator wheel) move in the direction parallel to the path of movement of the containers for too short a time. The containers are moving in a straight line, whereas the closure carriers are moving around a circular path which parallels the container line at only a single point. The axis of the closure is skewed to the axis of the container immediately before and immediately after a fleeting moment of alignment. Consequently there is only a very brief moment when downward force can be applied to the closure to secure it.

The capper or closure applicator in accordance with this invention includes a closure conveyor in the form of an endless loop having holders for receiving and carrying individual closures from a closure feeder to the containers. Preferably the closure conveyor loop is an oval or "racetrack" lying in a vertical plane directly above the path of movement of the containers on the container conveyor. As the closure conveyor moves around its loop path, it moves the holders along a closure applying run which is parallel to the path of containers on the container conveyor. Along that run each closure holder is oriented in axial alignment with the axis of a container. The parallel, straight line paths of the containers and closures provides a longer period over which axial and/or rotary force can be applied to each closure to secure it.

Closures are fed into the respective closure holders from a closure source, preferably from a star wheel on a second, upper run of the closure conveyor. The holder receives the closure and grips it as the holder moves from the point of receipt of the closure, to the point at which the closure is lodged on the respective container.

In preferred form each closure holder is mounted to a hinged plate or segment of the closure conveyor. The holder includes a body formed by upper and lower outer sleeves which are mounted perpendicularly to the conveyor segment. A spindle housed within the sleeves is body is movable both rotationally and axially relative to the body, and has a closure receiving chuck at an outer end. A pulley journaled on the body is connected by a magnetic clutch to the spindle to rotate the spindle, the pulley being fixed axially relative to the body. The spindle is biased axially in the body to follow the axial extension movement of cam followers which engage stationary cams, to move the spindle and thereby extend the chuck. The cam followers are biased toward engagement with fixed cams, or toward return position when the followers are not on the cams. The spindle has a stop collar which forces it to move positively with the follower (without lost motion) toward its retracted position. The spindle is also biased to move with the followers toward an extended (closure-applying) position. The spindle is splined to the clutch, so that it can move rotationally with the driven side of the chuck while moving axially along the spline. The spindle in turn axially houses an ejector stem which operates an ejector push plate in the chuck. The ejector can be moved axially relative to the spindle in order to eject a closure that remains lodged in the chuck after the chuck has passed the closure applying station.

In order to heat and thereby soften closures immediately prior to application, steam is applied around the closure while in the chuck, through passages that include a valve to apply steam only as the closure is moving toward the closure applying station.

In addition to extending to engage and torque (tighten) a closure on a container, the spindle is also preferably extended from the holder body to receive the closure from a closure feeder. This enables the chuck to telescope around the side wall of the closure as the closure is being moved in synchronism by the feeder. After extending to grip the closure, the spindle is retracted into the holder as the holder moves around the upstream end of the applicator loop (the end from which the container moves). Along the lower run the spindle and chuck are moved downwardly, or toward the container, to engage the closure on the container.

In addition to applying screw-on closures, the apparatus is suitable for use with press-on type closures, that is, closures of the type which are pressed axially onto a container without axial rotation, as well as with closures having continuous or discontinuous threads or lugs which require rotation to secure them. For axial rotation the closure holder is preferably engaged on at least one side by a frictional member which turns it around its axis in the direction to secure the threaded or lugged closure onto the container, while the spindle is biased toward the container. During this procedure the container is clamped in conveyor pockets in fixed relative position to the axis of the closure.

The sealing machine of the present invention can consistently achieve a higher rate of closure application than previously known machines, especially when applying a closure of the type having a breakaway tamper-evidencing band.

DESCRIPTION OF THE DRAWINGS

The invention can best be further described by reference to the accompanying drawings, in which.

OVERALL DESCRIPTION

The structure and operation of the capper of this invention are described primarily by reference to a preferred embodiment in which large mouth jars are filled with a food product and capped with tamper evidencing screw type closures which may for example be of the type disclosed in Ochs U.S. Pat. No. 5,009,324, titled "Closure Having Thermally Responsive Water Washing Slots." However, it should be understood that the capper can alternatively be used with closures having other types of tamper evidencing means, or having lugs rather than threads, and with press-on closures which do not require rotation to seat them.

Figure 2:
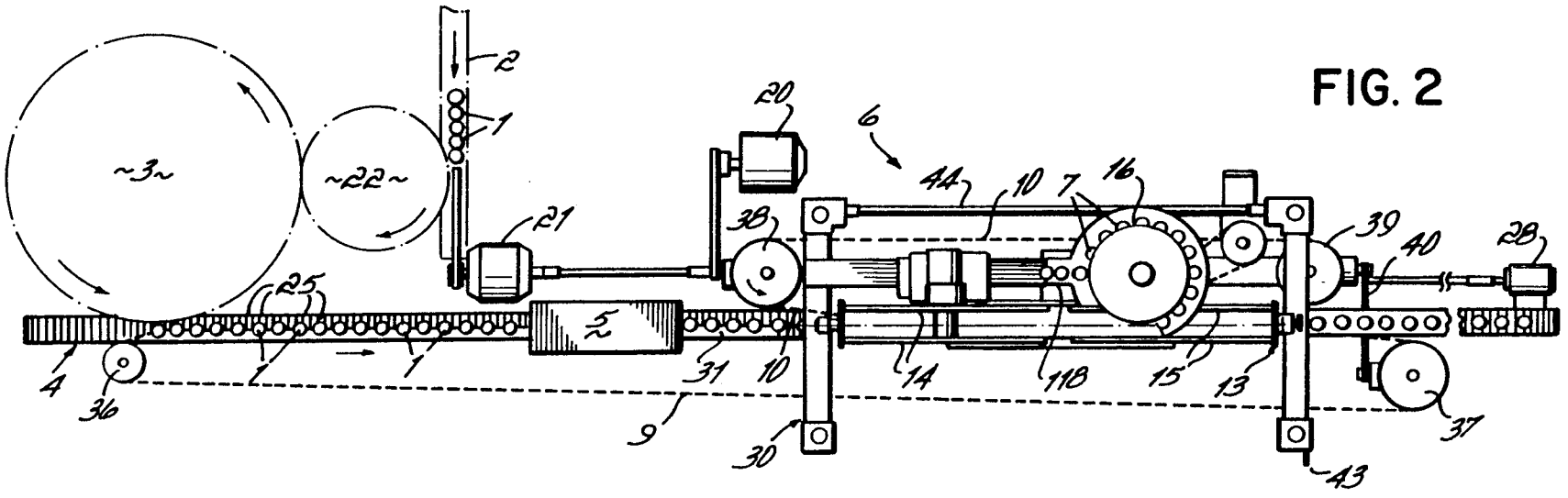
FIG. 2 is a top view, partly in phantom, of the capper.
Figure 3:
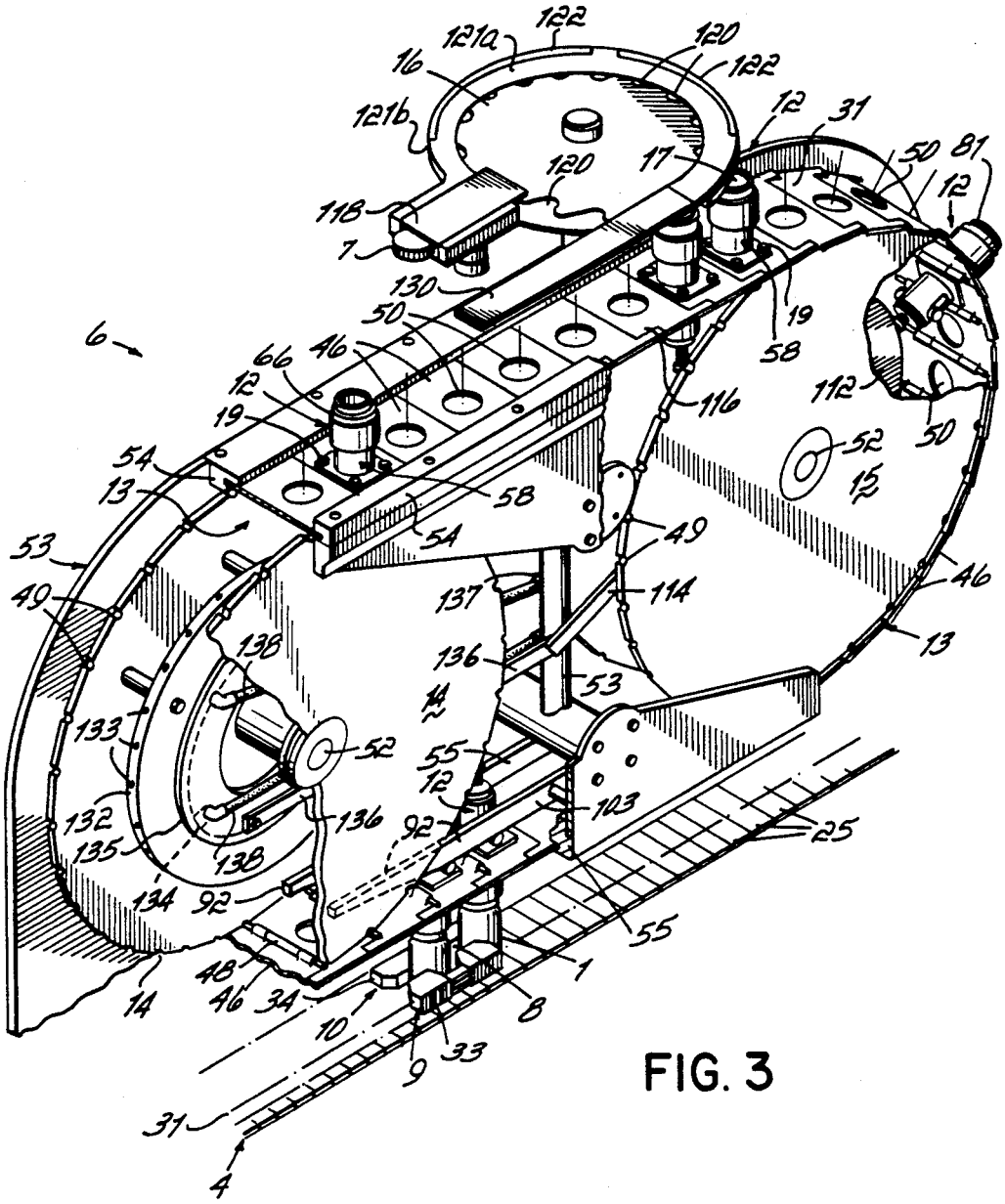
FIG. 3 is a perspective view, partly broken away, of the capper.

In broad summary, the overall operation of the illustrated apparatus is as follows: Referring first to FIGS. 2 and 3, empty containers 1 are supplied via a container infeed conveyor 2 to a filler 3 where they are filled with measured amounts of food product, then are delivered in spaced apart, single file relation to container conveyor 4 on which they are engaged on one side by a conveyor 9 that runs above conveyor 4. The conveyors 4 and 9 move in synchronism; conveyor 4 supports the containers while conveyor 9 precisely positions and positively moves them. The filled but still open containers are moved through a washer 5 and then into a capper designated generally at 6, in which closures 7 are applied to the individual containers 1. In the capper each container 1 is gripped in clamp pockets 8 which are presented between conveyor 9 on one side and a clamping conveyor 10 on the opposite side. The closures 7 are delivered and applied onto the containers 1 by a series of closure holders 12 which are mounted on a closure conveyor 13. Conveyor 13 can be horizontally or preferably vertically oriented and is in the form of an endless "racetrack-shaped" oval or loop which moves around end sprockets 14, 15. Movement of closure conveyor 13 is synchronized with that of container conveyor 4 so that the closures 7 are delivered on the lower or closure applying run of conveyor 13, in axially aligned positions above the respective containers.

The closure holders 12 receive the closures on the upper run of conveyor 13, from a closure feed star 16 (FIG. 3). Each closure holder 12 has a chuck 17 which is moved upwardly, below the periphery of star 16, to telescopingly receive and grip a closure 7. As the closure holder is moving around drive sprocket 14 of conveyor 13, and is approaching the container conveyor, steam or other heat can be applied to the closure to soften and/or sterilize it. On the horizontal lower run of closure conveyor 13 the holders 12 move lineally, parallel to the containers. Steam is also preferably applied into the open mouth of the respective container on conveyor 13 to displace air therein so that a vacuum will be created after the container has been sealed and cooled. The holder chuck 17 is extended downwardly to apply the closure onto the container 1, and, for screw or lug type closures, is rotated to torque the closure onto the container. The closure holder 12 includes a drive pulley which is engaged by differentially speeded drive means on opposite sides. Rotation of the pulley is transmitted to the chuck by slip clutch means; forced axial movement and forced rotation of the chuck are both avoided. The container is clamped against rotation in the pocket 8 between conveyor 9 and clamping conveyor 10. After the closure has been secured on the container, rotation stops and then chuck 17 is removed upwardly from the closure, leaving the closure secured on the container. The holder 12 then moves around the other end sprocket 15 of closure conveyor 13. After closure application, conveyor 4 carries the now sealed container beyond capper 6 for further processing, labeling, and/or packing. Before the chuck 17 again passes closure feed star 16 to pick up another closure, the chuck is cleared of any closure which may remain in it, so that it is empty for reloading.

With this general description, the structure of the apparatus is next described in greater detail.

Container Filling

Container infeed conveyor 2 is preferably disposed to move at a right angle toward the path of movement of container conveyor 4 (see FIG. 2), in order to save space. The rate of movement of the two conveyors 2 and 4 is synchronized, preferably by a common drive motor or prime mover 20 which supplies rotational movement to all the conveyors, through a suitable speed changer gearing and a timing unit 21, which may be of a type known in the art and therefore is not further described. The containers are transferred from infeed conveyor 2 by a filler feed star 22 (shown schematically in FIG. 2) into filler 3. The filler may also be of known type and does not comprise the invention. The filler 3 delivers the filled but still open containers onto the upstream end of conveyor 4.

Conveyor 4 comprises hinged segments or plates 25 which move in a vertical plane around horizontal end rolls 26, 27 (see FIG. 1), end roll 27 being driven through gearing mechanism 28 (see FIG. 2). Conveyor 4 is supported on a frame 30 which positions its upper run 31 in a substantially horizontal plane. Frame 30 may include a funnel shaped debris collector 41 (FIG. 1) below conveyor 4, into which broken containers or lost closures will fall. From FIG. 1 it can be seen that drive mechanism, gear boxes, and electrical and other associated equipment can be so positioned as to facilitate cleaning the floor under the line.

Filler 3 delivers the filled containers onto conveyor 4, into laterally open pockets 8 presented between pairs of spaced blocks 33, 33 on side conveyor 9. The blocks 33, 34 may be of the type described in the Herzog '260 patent previously referred to. The conveyor 9 lies on one side of conveyor 4, and moves in a horizontal plane about vertical end sprockets 36, 37. As shown in FIG. 3, the blocks 33 engage the individual containers on one side and space them apart on conveyor 4, sprocket 37 being arranged to drive side conveyor 9 in synchronism with conveyor 4. After the containers move through washer 5 (if employed), into the capper 6, the containers 1 are positioned more precisely and are clamped against rotation relative to the container blocks 33. This is accomplished by engaging them on the opposite side by a series of blocks 34 on clamping conveyor 10. Like side conveyor 9, clamping conveyor 10 is endless and moves in a horizontal plane about end sprockets 38, 39 (FIG. 2). The respective drive sprockets 37 and 39 are operated from motor 20 to move conveyors 9 and 10 in synchronism with one another and with conveyor 4, as by suitable gearing and timing belts 40.

The Closure Conveyor

Figure 1:
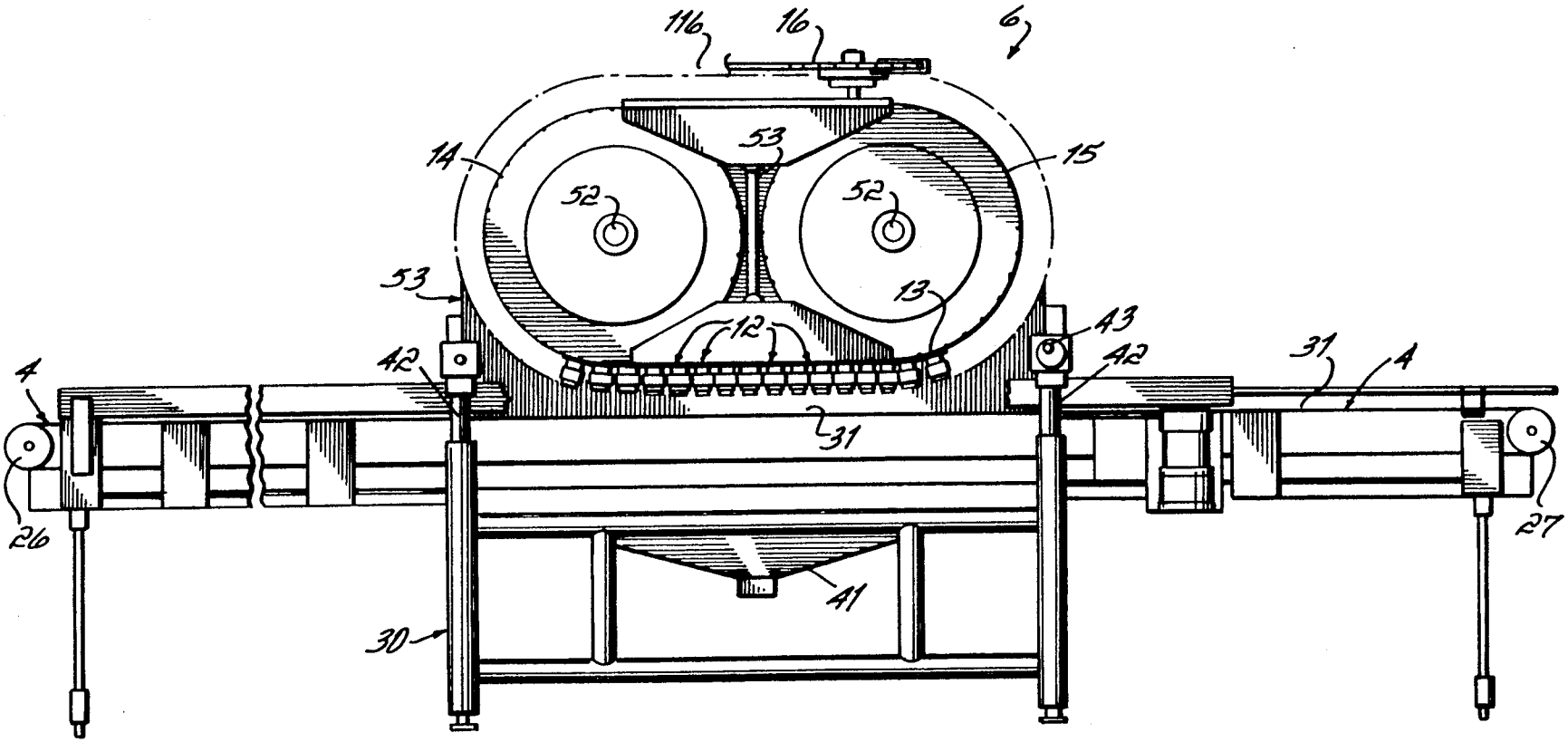
FIG. 1 is a front elevation, partly broken away, of a capper in accordance with preferred embodiment of the invention.

As shown in FIGS. 1 and 3, the capper assembly or capper 6 is positioned above container conveyor 4. The spacing between it and the upper run of conveyor 4 can be adjusted by means of vertically movable posts 42, the height of which can be changed by a crank mechanism 43. A crank may be mounted to one floor post 42 to operate it and is connected by suitable gearing and connecting shafts 44 (see FIG. 2) to similar elevating means on each of the other three posts 42, so that all four posts are raised or lowered in parallelism. This greatly facilitates the changes needed to accommodate containers of a different height. It also makes possible the installation and removal of conveyors 9 and 10 without taking apart the upper portion of the machine, in order to change jar pocket size, and/or to install instead an endless "timing gear" belt having integral molded jar pockets.

Figure 4:
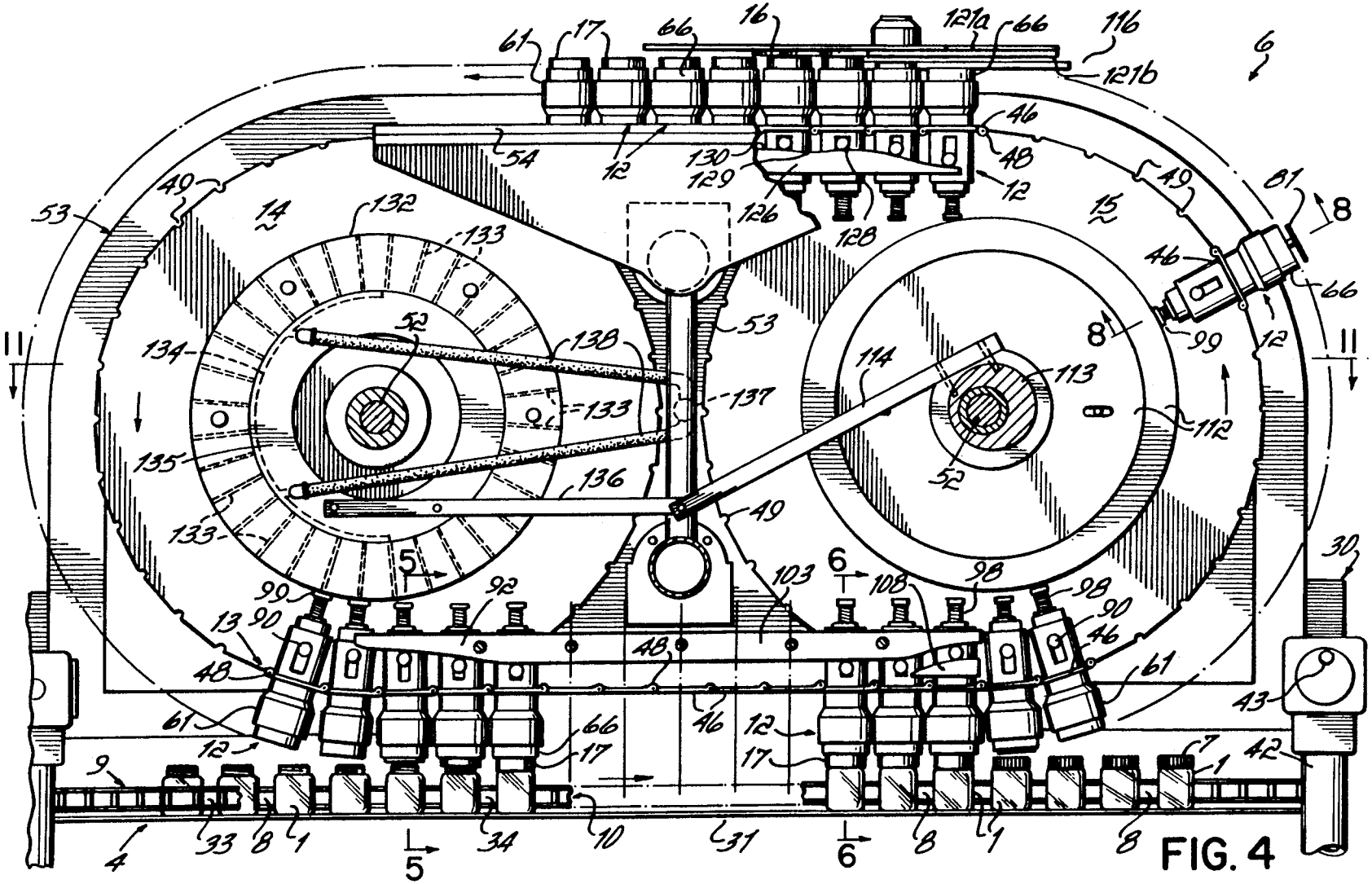
FIG. 4 is an enlarged elevation, partly in phantom, of the closure conveyor.
Figure 5:
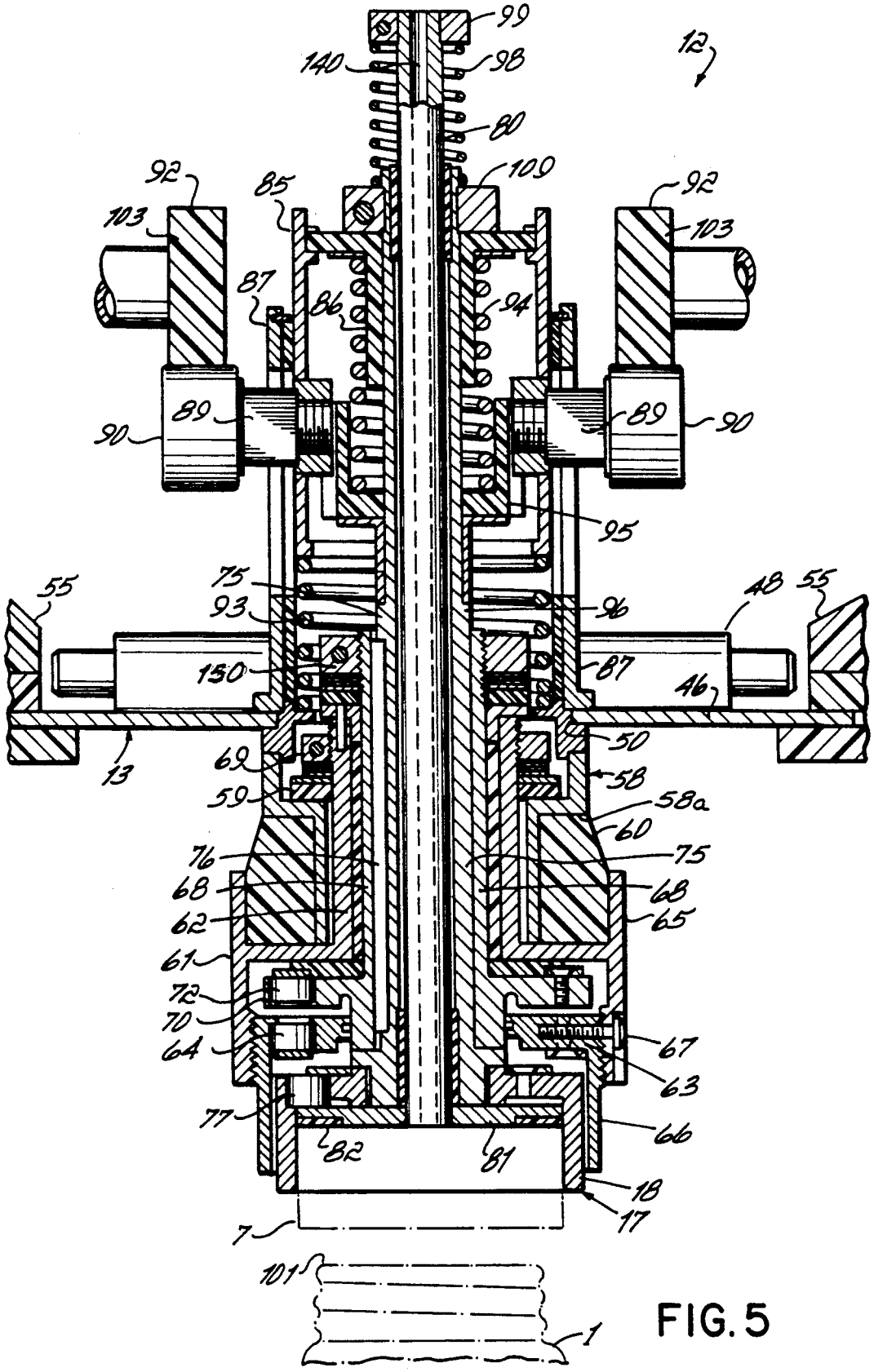
FIG. 5 is an enlarged axial section taken along line 5—5 of FIG. 4, showing a closure holder and the cam mechanism for advancing a closure-carrying holder toward a container at the closure applying station.

Capper 6 includes closure conveyor 13 which preferably rotates in a vertical plane, around laterally spaced drive sprockets 14, 14 at one end and driven sprockets 15, 15 at the other. Conveyor 13 is preferably comprised of articulating holder supports, segments or plates 46 (see FIG. 3), which are hinged together by connecting pins 48 along their transverse edges (FIG. 5). The pins 48 are mounted across the plates 46 and project outwardly, in position to be received in and carried by notches 49 in the sprockets 14, 15 (see FIGS. 3 and 4). Each support or plate 46 has a central aperture 50 in which a closure holder 12 is received. (For purposes of simplification some holders 12 and other components are omitted in FIG. 3 and other drawings.) Each sprocket 14, 15 rotates on a horizontal axle 52, and at least the lower run of the closure conveyor 13 is parallel to the upper run of container conveyor 4. The side edges of support 46 are preferably guided in edge guides 54, 55 along the upper and lower runs (FIG. 3). Edge portions of the support 46 are longitudinally extended or offset to provide an effectively longer edge surface for guiding in the edge guides 54, 55 (see FIG. 3). The sprocket shafts 52, 52 and the journals on which they are mounted are journaled in bearings mounted to a closure conveyor frame 53 which is supported on posts 42.

The Closure Holders

A single closure holder 12, as mounted to a support 46 of closure conveyor 13, is shown at sequential stages of the closure applying procedure in FIGS. 5, 6, 7 and 8. Holder 12 is housed in a stepped tubular body comprised of an upper body sleeve 87 and a lower body part 48. The body is secured to support 46 around an aperture 50 therein, as by bolts 19 (see FIGS. 3 and 7A). A rotary and thrust bearing 60, press-fitted in a clutch drive pulley 61, is journaled on an inset shoulder 58*a* of lower body 58, below aperture 50. A skirt 66 having an inwardly extending annular flange 63 is threaded to pulley 61, and a circular set of drive magnets 64, only one of which is shown, is mounted on that flange 63. The outer surface 65 of clutch drive pulley 61 is cylindrical and has a high friction surface such as knurling, which can be engaged to rotate the pulley on body 58 (see FIG. 7). Pulley 61 has an internal axial sleeve 62 in which is journaled a torque bushing 68, the bushing being rotatable within the pulley. Torque bushing 68 includes an outwardly extending flange or shoulder 70 which is parallel to but spaced axially from the magnet carrying flange 63 of clutch drive pulley 61. Flange 70 mounts a set of permanent magnets 72 which are generally symmetrically disposed with respect to the drive magnets 64 on flange 63. The spacing between the two sets of magnets 64, 72 is adjustable, and the sets are magnetically coupled so that when pulley 61 is rotated, the movement of its magnets 64 tends to cause the magnets 72 to rotate with them, and hence to turn torque bushing 68. The magnet sets 64, 72 act as a magnetic clutch whereby external rotation imparted to the clutch pulley is yieldably transmitted to the torque bushing 68. The clutch is preferably concentric to and radially within the pulley 61. The spacing or gap between the magnets 64, 72 can be adjusted by changing the axial position of threaded skirt 66 on the pulley 61. Each magnet is retained in its bore by an annular shoulder at one end of the bore and a retainer ring on the other end. The skirt can be threaded upwardly or downwardly in the pulley and fixed in position by a lock screw 67. A lock ring 69 is threaded around sleeve 62 of pulley 61 and axially positions the pulley on body 58 through spring washers and a plastic thrust bearing 59, so that the pulley 61 ca rotate relative to body 58 but cannot move axially with respect to it. A second lock ring 150 (FIGS. 5 and 7A) is threaded around the bushing 68 and axially secures the upper set of clutch magnets 72 in flange 70 to the pulley sleeve 62 so the spindle bushing 68 is free to rotate relative to the pulley 61 but is axially secured relative to the pulley to accurately maintain the gap between the clutch magnets 64 and 72.

An elongated spindle 75 extends through an axial bore in torque bushing 68, and the spindle and torque bushing are splined together by a key 76 which permits spindle 75 to move axially but not rotationally relative to the torque bushing. At the lower end of spindle 75, axially adjacent pulley 61, chuck 17 is secured. The chuck has a skirt with an axial opening that is sized and shaped to telescope around the side wall of the closure 7. The chuck fits closely within a skirt 66 of the pulley, or a filler sleeve is provided (not shown) to close the annular gap if a smaller chuck is used. Although not shown in FIG. 5, the inside wall of the chuck may be configurated with ribs or grooves to better grip closure 7. Where the closure is metal, or has a metal insert disk, it is desirable to provide one or more closure holding magnets 77 on the inner end of the chuck to assist in holding the closure in the chuck.

Spindle 75 is tubular and has an open center, through which an elongated stem 80 extends axially. A push plate 81 is attached to the lower end of stem 80. The magnetic force of the magnets 77 acts through the push plate. The stem is normally retracted in spindle 75 so that the push plate is seated against the upper end of chuck 17 (see FIG. 5). When stem 80 is extended relative to chuck 17, push plate 81 will push a closure 7 out of the chuck (see FIG. 8). A non-metallic pad 82 on push plate 81 prevents metal-to-glass contact in the event there is no closure in the chuck when the chuck comes down on the container, and thus minimizes the possibility of glass breakage.

Figure 7:
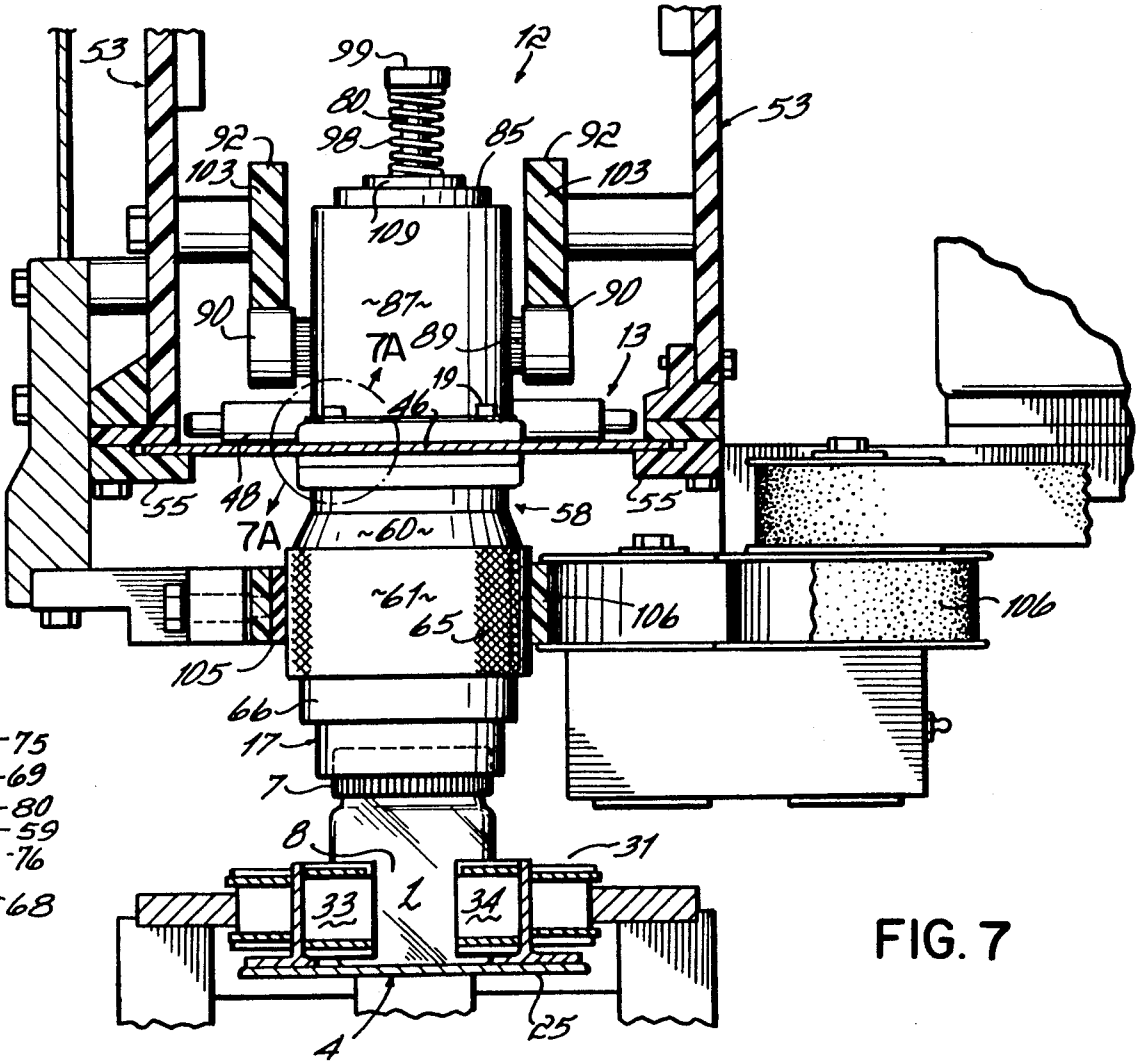
FIG. 7 is a transverse vertical section, partly broken away, of the spindle camming and rotating means, with a closure in the chuck engaged on a container.
Figure 7A:
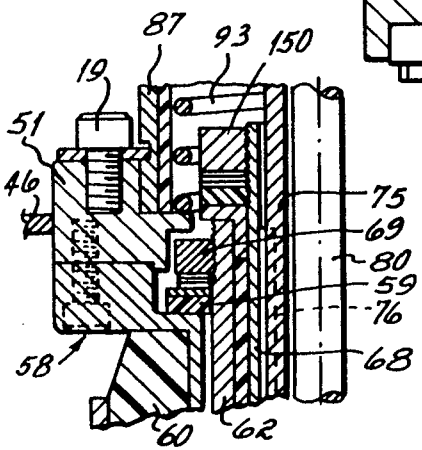
FIG. 7A is an enlarged vertical section through the portion of the holder which is circled in FIG. 7.
Figure 8:
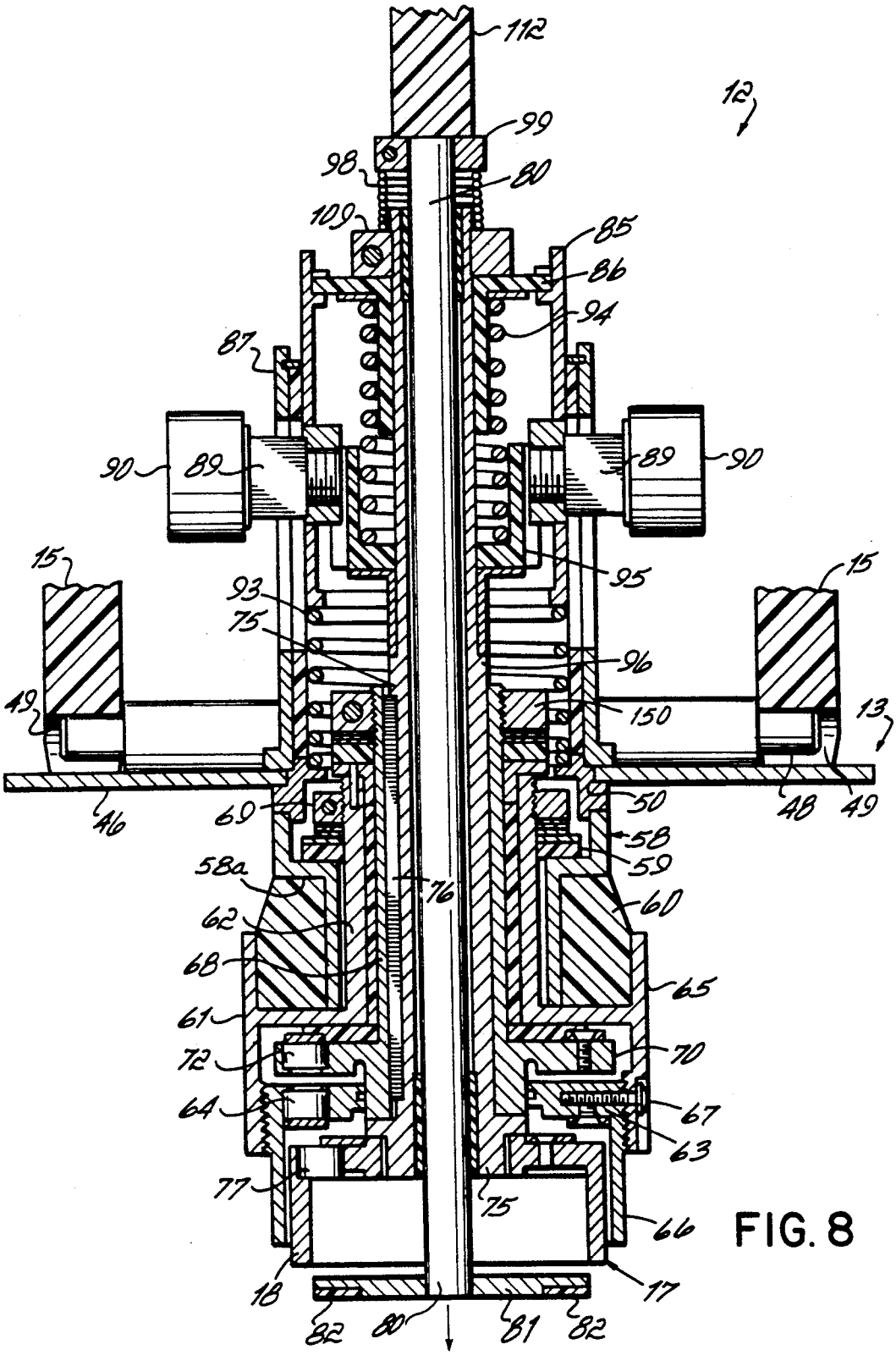
FIG. 8 is an axial section taken on line 8—8 of FIG. 4 and illustrates the holder ejecting a closure retained in it after the holder has passed the closure applying station, prior to receiving another closure.

On the upper side (as viewed in FIG. 5) of carrier holder support 46, a sleeve-like member or "slider" 85 is axially slidable inside a sleeve bearing in a fixed upper body sleeve 87. Sleeve 87 is secured to support 46 by bolts 19 through a collar 51, as shown in FIGS. 7 and 7A; the lower body 58 is in turn bolted to collar 51. At its center slider 85 has a plastic sleeve bearing 86 which provides a rotary and axial journal for the upper end of spindle 75.

A pair of diametrically opposed arms 89, 89 extend outwardly from the outer wall of slider 85, through slots in upper sleeve 87. The arms 89 carry rotary cam followers 90, 90 which, as the closure holders 12 move around the loop of conveyor 13, come into engagement with opposed fixed cams 92, 92 (see FIGS. 4 and 5). A cam follower biasing spring 93 biases slider 85 (and hence the cam followers 90 attached to it) away from support 46, toward engagement with the cams 92. Another biasing spring 94 bears upwardly on slider 85 at one end and downwardly at the other end (as viewed in FIG. 5) against a shouldered plastic spring retainer 95 which in turn bears axially against a peripheral shoulder 96 on spindle 75. Thus biasing spring 94 tends to push the spindle downwardly with respect to cams 92. From FIGS. 5 and 6 it can be seen that as cams 92 move cam followers 90 downwardly, the upper end of slider 85 also moves downwardly, thereby tending to compress spindle biasing spring 94. Spring 94 in turn yieldably urges the spindle 75 downwardly, moving chuck 17 with it. Thus the spindle is biased to yieldably follow the configuration of the cam 92 as follower 90 moves along the cam, but yields when a closure in the chuck engages a container. The spindle is moved upwardly when bearing 86, attached to slider 85, abuts a collar 109 secured to the spindle. It should be noted that the axial movability of spindle 75 relative to the magnetic chuck 64, 72 isolates the clutch from axial thrust so the collar tightening torque is not affected by the thrust.

An ejector stem biasing spring 98 at one end bears upwardly on collar 99 attached to stem 80 and downwardly at the other end against collar 109 on spindle 75. Spring 98 thus tends to bias ejector stem 80 upwardly toward the retracted position shown in FIG. 5 in which its push plate 81 abuts the inner end of chuck 17.

The shape of cams 92, 92 controls the vertical movement of chuck 17. The cams advance the chuck toward the finish 101 of a container 1 to carry a closure 7 in the chuck into engagement with the container finish when the holder 12 comes onto the cams 92 on the horizontal run of conveyor 13. Rotation imparted to the outer surface 65 of chuck drive pulley 61 acts through torque bushing 68 and spindle 75, to turn chuck 17. It can be seen that the yieldability provided by spindle biasing spring 94 prevents the cap threads from being too vigorously pressed against the threads of a container at high running speeds, and that the rotational slip provided by the magnetic (or other) clutch between drive pulley 61 and chuck 17 permits the chuck to slip when the closure has been properly tightened on the container 1.

Cam Operation Of The Holders

Figure 6:
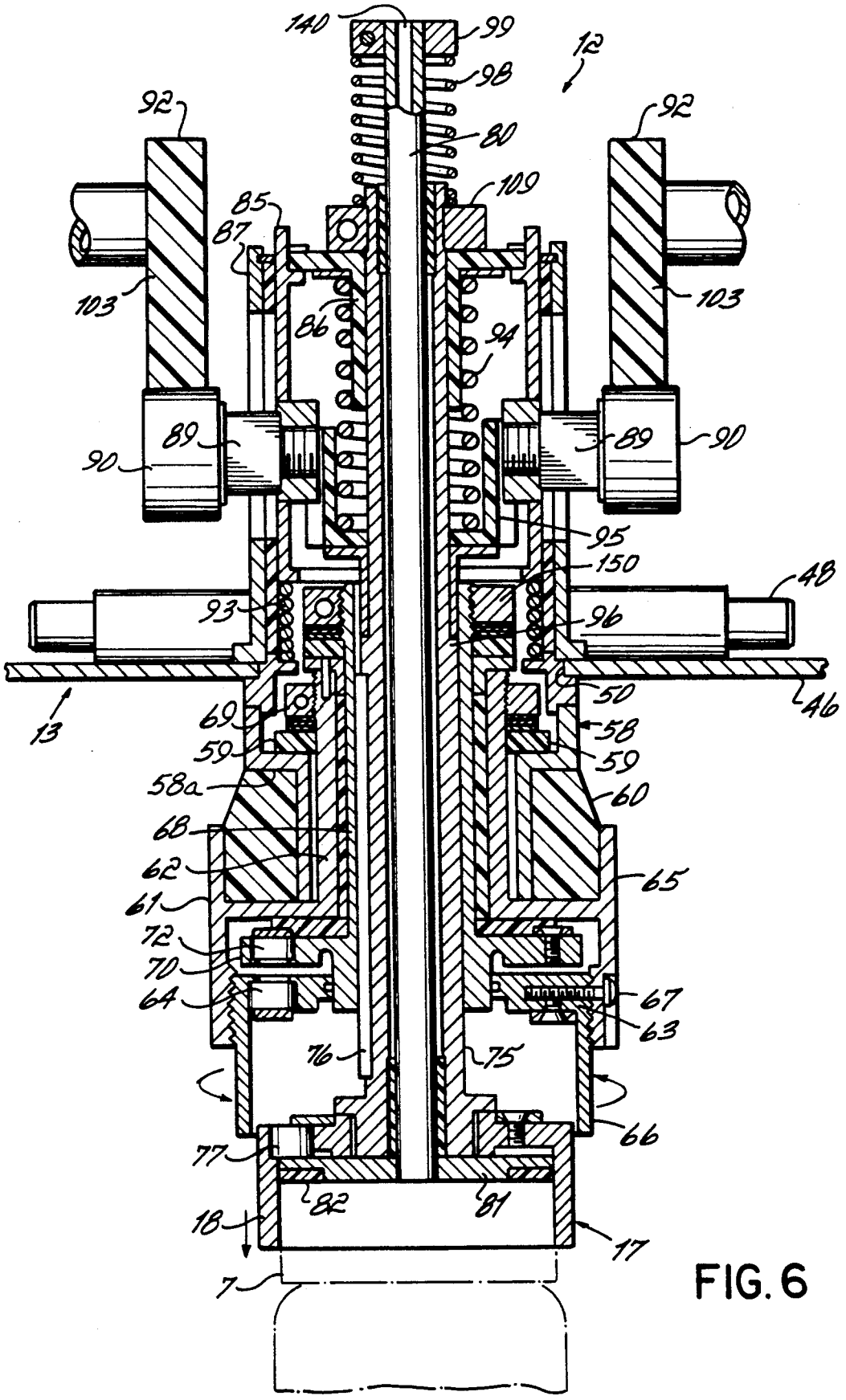
FIG. 6 is an axial section similar to FIG. 5 but is taken on line 6—6 of FIG. 4 and shows the holder as it is being rotated and advanced axially to secure the closure onto a container.

As closure conveyor 13 turns, each closure holder 12 on it is engaged and operated for different functions by fixed cams. As a particular holder 12 moves counterclockwise around the left sprocket 14 toward its lower run, as seen in FIG. 4, cam follower 90 of the holder engages the cam surface of a cam 92 presented on bar 103 which is fixed with respect to the frame 53 of capper 6. As shown in FIG. 4, the cam surface of cam 92 extends gradually downwardly, in a direction toward the containers 1 moving on the container conveyor 4 beneath the sprocket 14. As previously indicated, the lineal positions of the holders 12 are synchronized with the axes of the containers which are in turn fixed by the pockets 8 in which the containers are clamped, so that the axes of each closure and the respective container are aligned vertically (see FIG. 4). The cam surface 92 pushes the follower downwardly, that is, toward the container, thereby carrying the closure resiliently into engagement with the container finish, as shown in FIGS. 5 and 6. Chuck drive pulley 61 is then rotated, thereby rotating the chuck and closure to secure closure lugs or threads with those of the container. Rotation of pulley 62 is preferably accomplished by frictionally engaging one side of the pulley against a stationary frictional pad or shoe 105 (FIG. 6) and the opposite side by a moving belt 106. This rotates the chuck as it is moving lineally, and the closure is torqued on. Engagement of the securing members of the closure with the cooperating securing members of the container draws the closure downwardly onto the container. When the closure is fully tightened, the magnetic clutch 64, 72 slips. The peak value of tightening torque can be adjusted by the changing degree of magnetic coupling between the magnets, as previously explained.

The spindle is in the down or extended position (shown in FIG. 6) as the holder traverses the lower run of the loop between sprockets 14 and 15. As the holder approaches sprocket 15 at the downstream end of loop 13, the cam followers 90 are cammed upwardly by lifting cams 108, which positively lift cam followers 90 and slider 85. As slider 85 moves upwardly it abuts lock collar 109 on spindle 15, thereby lifting the spindle with it. The pulley is no longer being rotated at this point. After the chuck has been lifted axially away from the closure, which remains on the container clamped in its pocket 8, plate 46 begins to move around the periphery of sprocket 15 (see FIG. 4).

Retained Closure Clearing

Figure 11:
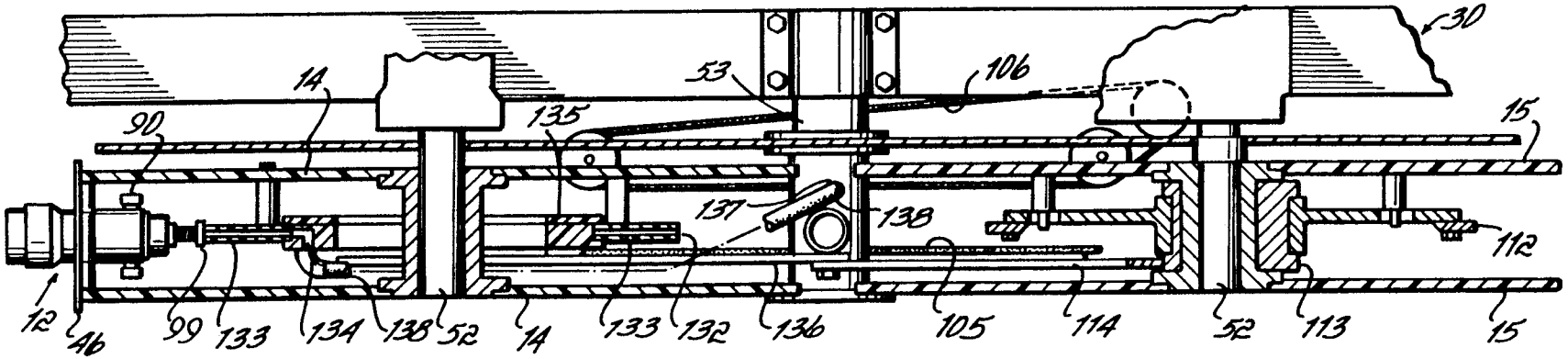
FIG. 11 (which appears on the same sheet as FIG. 2) is a horizontal section taken on line 11—11 of FIG. 4.

If for some reason a closure should improperly remain in its chuck after the holder leaves the lower run of the loop, it is desirable to insure that the chuck be cleared automatically before it approaches the loading station at which another closure will be presented for loading. Closure ejection means, shown in FIGS. 3, 4 and 8, moves stem 80 outwardly so that the stem push plate 81 positively shoves any remaining closure from the chuck. Spindle 75 is not displaced or rotated as this occurs; only the stem is pushed. This is caused to occur by engagement of the cam following collar 99 at the end of the stem, with an ejection cam 112. Cam 112 is an annular ring on a disk which is positioned midway between the two drive sprockets 15, 15 (see FIGS. 3 and 11). Cam 112 is journaled on axle 52 by an eccentric bearing 113. A tie rod 114 is connected between eccentric bearing 113 and a fixed point on the capper frame 53 to prevent the bearing from rotating. Collar 99 on stem 95 is the cam follower and comes into engagement with cam 112 when the respective holder 12 begins to move around sprockets 15 at the downstream end (the right end, in FIG. 4) of conveyor loop 13. The cam positively pushes collar 99 outwardly, overcoming the bias of ejector stem spring 98. The stem movement causes ejector push plate 81 to shove any retained closure out of the chuck. The outer periphery of the non-metallic pad 82 on plate 81 moves against and wipes the inside wall of chuck skirt 18 and thus helps clean the chuck every time the push plate is operated. The ejector cam follower collar 99 moves off cam 112 and the push plate is again seated in the chuck before another closure is loaded into the chuck, which is next described.

Closure Loading

Figure 9:
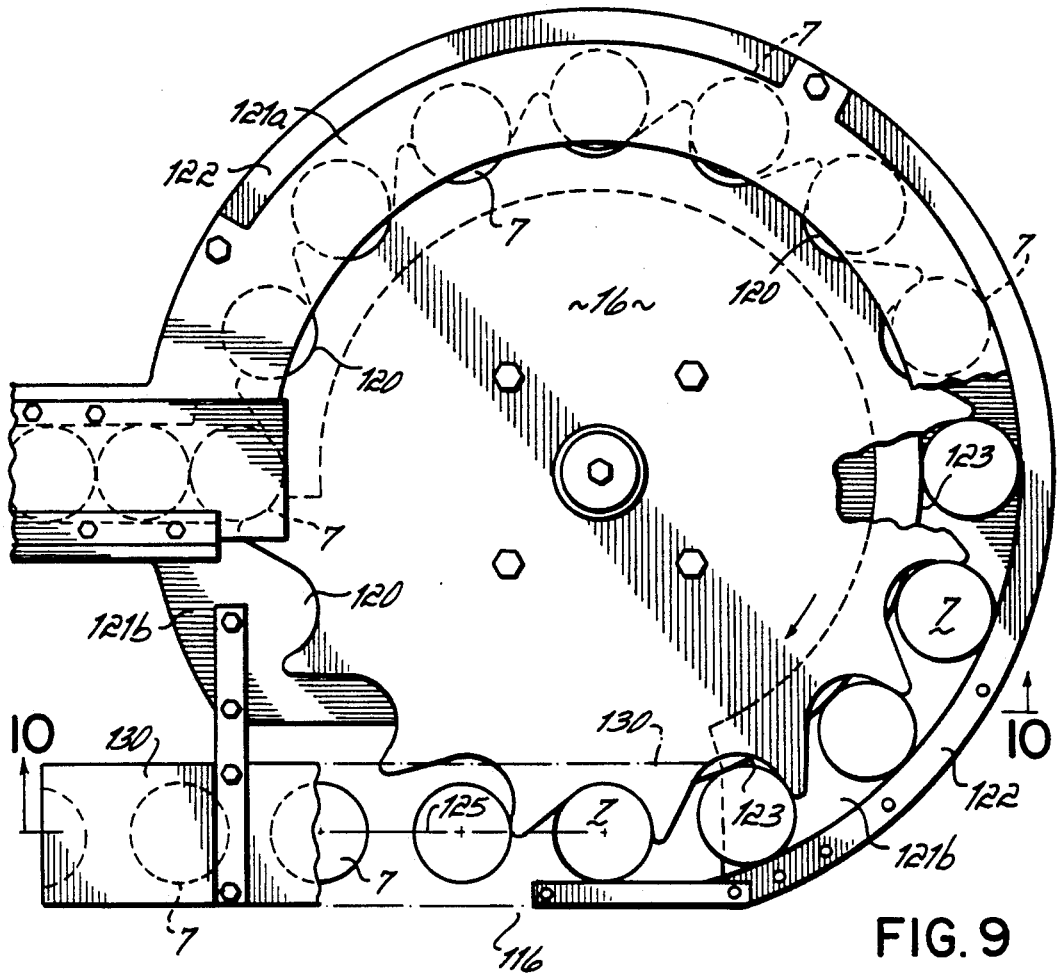
FIG. 9 is a top plan of the star wheel closure feeder shown in FIG. 3.
Figure 10:
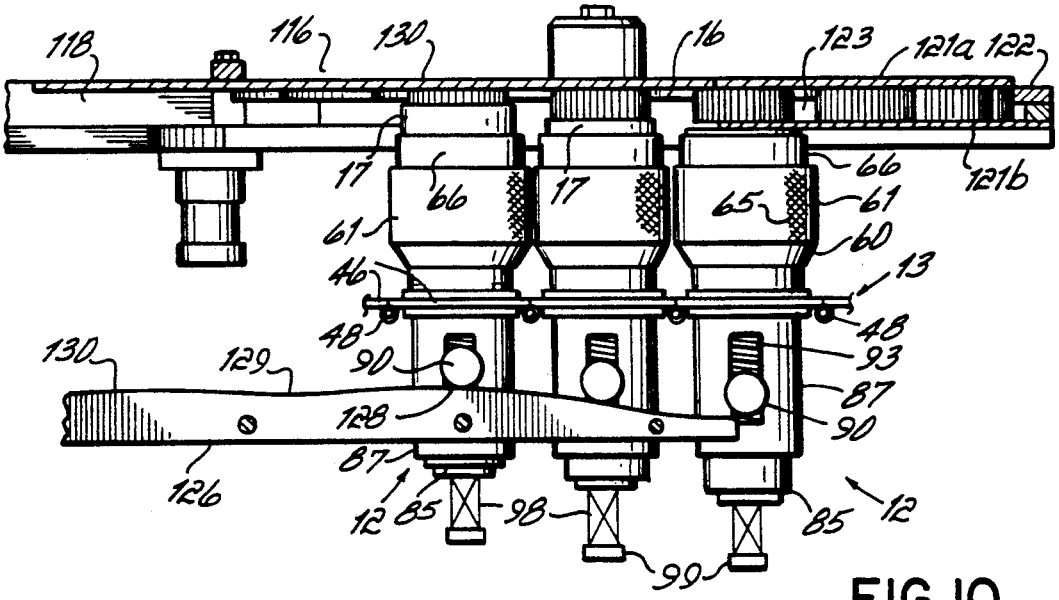
FIG. 10 is an elevation, partly broken away, taken on line 10—10 of FIG. 9, showing the cam mechanism for extending a holder to telescope around a closure from the feeder.

Closures are placed or loaded into the respective chucks on the upper run 116 of the closure conveyor 13, as the chucks are moving from sprocket 15 toward sprocket 14. As previously described, on this upper run 116 the conveyor holders or plates 46 slide in edge guides 54 which prevent conveyor sag and lateral displacement. As shown in FIGS. 2 and 3, closures are fed in single file through a closure feed chute 118, in which they are biased toward a closure feed star 16. (The feed means may be of known type, for example as shown in U.S. Pat. No. 3,714,760.) Star 16 is operated by motor 20 so that the centers of its notches or pockets 120 are aligned with the upwardly facing chucks 17 on run 116. Each notch 120 picks a closure 7 from chute 118 and carries it around the periphery of the star until it is positioned over a chuck. The closures are confined in the notches 120 by and between upper and lower star guide rails **121*a*, 121*b*, and an edge guide rail 122 (see FIGS. 9 and 10). As the closure approaches run 116, it is displaced radially outwardly in its pockets 120 by a cam 123 as it continues to be moved by the following tooth of the star. In this manner, as the star pocket swings toward, then tangentially to, then away from, the center line (dotted line 125) of run 116, the closure is moved lineally by the star. As the closure comes off the downstream end of lower guide 121*b*, the chuck is moved upward to telescope around the closure which is held against upward movement by plate 121*a* above it, as best shown in FIG. 10. Upward movement of the chuck is caused by engagement of cam follower 90 with closure loading bar cam 126**.

In FIG. 10, it can be seen that the shape of closure loading bar cam 126 moves the chuck upwardly to pick up a closure as the cam follower 91 passes over a peak or lobe 128, following which the chuck is retracted downwardly slightly as the follower tracks on a slight depression 129, followed by another rise at 130. The purpose of this is to first seat the closure deeply in the chuck, then to withdraw the closure from overlying plate **121*a* to prevent unnecessary scuffing or abrasion of the closure, and then to extend the closure again after the holder has moved beyond the end 130 of top plate 121*a***.

Closure Heating

It is usually desirable that both metal and plastic closures be heated before they are applied. In the case of plastic closures, the heating softens the closure skirt and thereby makes application easier and reduces breakage. Moreover, heating is useful to sterilize the closure prior to application onto the filled container and to avoid thermal shock between the closure and the heated container. In a preferred embodiment this invention includes means for applying steam onto the closures while they are being carried from the closure loading station to the applying station.

An annular ring-like steam manifold wheel 132 (see FIGS. 3, 4 and 11) is mounted to a sprocket 14 for rotation with it. This wheel 132 contains a series of radial steam supply bores 133 which, on the inside rim of the wheel, slide over and communicate with an inner steam supply channel 134 that extends halfway around a fixed disk 135. Disk 135 is journaled on axle 52 but is held against rotation by a tie bar 136. Steam from a steam inlet line 137 is supplied by lines 138, 138 into the channel 134. As can be seen in FIG. 4, channel 134 extends around approximately half the diameter of the disk 135. A supply bore 133 of manifold wheel 132 comes into communication with channel 134 when the respective holder begins to move downwardly around the peripheries of spockets 14, 14.

As shown in FIGS. 3-5 and 11, a steam supply bore 140 extends axially in holder stem 80, through the cam collar 99 at the upper end thereof, through stem push plate 81, and into chuck 17. The cam collar 99 of the holder engages the periphery of steam manifold wheel 132 approximately where steam is supplied to bore 133 thereof. Steam under pressure is thereby applied into bore 140, and steam flows around the inner end of the closure in the chuck and outwardly around between the chuck side wall and the closure, thereby heating the closure. The temperature and rate of flow of the steam are adjusted to provide the desired degree of heating and/or sterilization. Steam lines (not shown) can also be provided to direct steam onto the finishes or into the open upper ends of the unfilled containers prior to closure attachment, to sterilize the finish or to displace air. Cooling and condensation of the steam after sealing creates a vacuum pack.

Because chuck skirt 18 surrounds the closure, it prevents the heated (and therefore softened) wall of a plastic or composite closure wall from expanding radially when the closure is being tightened on a container. This reduces the chance of accidentally stripping the hot threads when the maximum torque is applied. This was a problem in previously known straight line cappers which used side belts or top belts to tighten closures.

Further Advantages

The structure described can operate at very high speed. Indeed, line speeds of 2,000 or more jars per minute are contemplated. The large diameter of the sprockets 14 and 15 minimizes centrifugal force on the closures and spindles at such high throughputs. For example, a sprocket having a diameter of 33" can apply closures at a rate of 2000 per minute to containers spaced on 3¼" centers, while rotating at only a rate of about 63 rpm.

The entire clutch, chuck and spindle assembly can be easily removed from the conveyor. This can be accomplished by removing the collars and bolts or other attaching means, without removing the conveyor from the machine and without taking the conveyor apart or disturbing other holders. For example, by removing the holder body bolts 19, and the collars 99 and 109, the entire pulley, clutch, and spindle assembly can be removed from the outside of the machine without disturbing the cams, cam followers, or their mountings. Thus the chuck, clutch and spindle assembly can be serviced and/or replaced quite easily without significant dismantling of the machine.

Each chuck 17 is rotated only as and when required, not continuously, that is to twist the closure onto the container. The magnetic clutch is not subject to wear and holds its torque setting well. The axial pressure applied to the closure by the spindle spring 94 is independent from the other mechanisms and can be controlled by the designed compression force of this spring.

Because the rotating spindle 75 is relatively lightweight, it has low inertia and can stop rotation rapidly when full application torque is reached. This minimizes torque variation due to high rotational speeds.

The closure is held in the chuck by magnets 77 and/or friction, which allows smooth ejection with a single moving part, namely the ejector stem 80.

The moving parts are sealed, which prevents the entry of dirt, chips, glass fragments or food.

The bearings are preferably plastic and do not require any lubrication, thereby minimizing the possibility of contamination of the food product.

The same pins 48 which hinge the conveyor plate 46 together also drive them, which reduces the number of parts required.

As previously noted, the chuck positions the closure axially with the container before bringing the two in contact, so that the chance of crossed threads or cocked caps is minimized. The positive cam actuated motion of the chuck, when the chuck is on center and aligned with the container before engagement, makes it easier to apply closures with a tamper band.

The construction is relatively simple and a minimum of machining is required.

Moreover, the foregoing advantages of this capper are all achieved without the disadvantages of a rotary capper such as centrifugal force which causes product to be thrown out of the jars at high speed and complex and expensive change-overs due to the jar grippers and spindle equipment for different jar sizes.

The full or telescoping encapsulation of the closure by the chuck allows full tightening of plastic closures, softened by heat, without thread stripping, even when the torque required to engage a break away tamper band over a corresponding bead on a container is greater than the torque needed to strip the cap. Again, this is achieved without the disadvantages of a rotary capper.

The invention has been described in relation to a preferred embodiment, but those skilled in the art will understand that it may be embodied in other structures, within the scope of the following claims.

What is claimed is:

1. A closure holder for a capper, comprising
   - a closure holder support mountable in a closure conveyor,
   - a closure holder body mounted to said support,
   - said body mounting a spindle having a closure-receiving chuck at one end thereof, said spindle mounted for rotation and axial movement in said body,
   - a rotatable pulley for applying rotation to said spindle,
   - a cam follower for following a cam,
   - means coupling said spindle to said cam follower and yieldably biasing said spindle to follow movement of said cam follower to extend said spindle, and
   - means for moving said spindle toward a retracted position, movement of said cam follower from a starting position yieldably moving said spindle to an extended position, said spindle being rotatable as it is moving toward said extended position.

2. The closure holder of claim 1 further including a clutch yieldably connecting said spindle to said pulley, rotation imparted to said pulley tending to rotate said spindle through said clutch.

3. The closure holder of claim 2 wherein said clutch is a magnetic clutch.

4. The closure holder of claim 3 wherein said magnetic clutch includes two spaced, opposed sets of magnets, said sets of magnets being magnetically coupled, one said set being mounted to said pulley and the other said set being connected to said spindle to rotate the latter, rotation of said one set with said pulley tending to rotate said other set.

5. The closure holder of claim 4 including means for adjusting the magnetic coupling between said sets of magnets by changing the spacing between said sets.

6. The closure holder of claim 5 wherein said one set of magnets is mounted to an inwardly extending shoulder on said pulley, and said other set is mounted to an outwardly projecting shoulder which is rotationally connected to said spindle, said shoulders being spaced axially.

7. The closure holder of claim 4 wherein said one set of magnets is movable in the axial direction of said spindle relative to said other set, and the spacing between said sets is adjustable by changing their axial positions relative to one another.

8. The closure holder of claim 1 wherein said pulley is journaled for rotation on said body.

9. The closure holder of claim 1 wherein said spindle is connected to said clutch by a bushing and said spindle is movable axially in said bushing.

10. The closure holder of claim 9 wherein said spindle is splined to said bushing for rotation therewith and axial movement with respect thereto.

11. The closure holder of claim 1 wherein said cam follower is mounted to a member which is axially slidable in said body, and said member is biased toward a home position.

12. The closure holder of claim 11 wherein said spindle is journaled for rotation in said member.

13. The closure holder of claim 12 including a coil spring between said member and said spindle, said spring urging said spindle toward an extended position with respect to said body.

14. The closure holder of claim 13 including stop means limiting the extent of movement of said spindle at said extended position.

15. The closure holder of claim 1 including a member which is axially slidable in said body, said spindle being journaled in both said member and said pulley.

16. The closure holder of claim 1, wherein said body extends perpendicularly to said holder support.

17. The closure holder of claim 1 wherein said cam follower is rotatable and has an axis of rotation which is perpendicular to the direction of movement of said support.

18. The closure holder of claim 1 wherein said chuck is at an end of said spindle and said pulley is axially adjacent said end of said spindle.

19. The closure holder of claim 1 wherein said pulley and chuck are concentric with one another, and said pulley encircles said chuck.

20. The closure holder of claim 1 wherein said spindle is retracted without yielding when said cam follower is returned to said starting position.

21. Apparatus for applying closures to containers, comprising, a conveyor for moving containers in a row along a straight line path of movement, an endless closure conveyor in the form of a loop, said closure conveyor mounting closure holders for movement along a run parallel to said path, each closure holder receiving a closure from a source and, while on said run, applying said closure onto a container while said container is moving along said path, each said holder comprising, a chuck for telescoping around a closure at said source, said chuck being axially movable between extended and retracted positions, means for extending said chuck from said retracted position to apply said closure onto a container, said chuck extending means being spring biased so that said chuck is extended resiliently.

22. The apparatus of claim 21 wherein each holder further comprises, means for rotating said chuck relative to the holder to twist a closure onto a container, said chuck being axially movable relative to said rotating means, said rotating means adapted to rotate said chuck in a range of axial positions of said chuck as said chuck is being extended.

23. The apparatus of claim 22 wherein said rotating means includes a clutch which yieldably applies torque to said chuck.

24. The apparatus of claim 22 wherein said rotating means rotates said chuck only while a closure in said chuck is being seated on said container.

25. The apparatus of claim 22 wherein said rotating means operates in synchronism with said conveyor at all speeds including starting and stopping.

26. The apparatus of claim 22 wherein said rotating means rotates said chuck before extension of said chuck begins and stops rotating said chuck before retraction of said chuck begins.

27. The apparatus of claim 21, further including means for positively retracting said chuck relative to said holder.

28. The apparatus of claim 21, wherein said holder further includes a magnetic clutch comprising two sets of magnets spaced axially in said holder, one set of magnets being driven by said rotating means, the other said set being connected to said chuck.

29. The apparatus of claim 28 wherein said chuck is axially movable relative to said other set of magnets.

30. The apparatus of claim 22 wherein said rotating means does not rotate said chuck when said chuck is in said retracted position.

31. The apparatus of claim 21 where the rate and duration of said rotating means is in synchronism with the operation of said conveyor.

32. The apparatus of claim 22 wherein said rotating means includes a pulley on said holder and drive means engageable with said pulley to rotate said pulley, and said chuck is axially movable with respect to said pulley.

33. The apparatus of claim 21 wherein said chuck extending means includes a cam adjacent said conveyor and a cam follower on each holder, said follower being engageable with said cam and operable to extend said chuck.

34. The apparatus of claim 33 wherein said cam follower is rotary and has an axis of rotation which is perpendicular to said loop formed by said closure conveyor.

35. The apparatus of claim 21, further including chuck retracting means for axially retracting said chuck with respect to the holder, said chuck being retracted positively without yielding, thereby to strip a closure if lodged in the chuck.

36. The apparatus of claim 21 wherein said closure conveyor moves in a path which lies in a vertical plane.

* * * * *